United States Patent [19]

Berland

[11] 4,452,198

[45] Jun. 5, 1984

[54] COMPACT DUAL SPARK INTERNAL COMBUSTION ENGINE

[75] Inventor: Craig A. Berland, Lansing, Mich.

[73] Assignee: General Motors Corporation, Detroit, Mich.

[21] Appl. No.: 392,791

[22] Filed: Jun. 28, 1982

[51] Int. Cl.[3] ..... F02B 3/00

[52] U.S. Cl. ..... 123/310; 123/638

[58] Field of Search ..... 123/310, 638, 640, 641

[56] References Cited

U.S. PATENT DOCUMENTS

| | | | |
|---|---|---|---|
| 2,609,805 | 9/1952 | Pescara . | |
| 2,827,892 | 3/1958 | McDuffie et al. . | |
| 2,833,254 | 5/1958 | Carpentier et al. . | |
| 4,116,179 | 9/1978 | Nagumo et al. . | |
| 4,133,331 | 1/1979 | Otsubo et al. | 123/638 |
| 4,177,640 | 12/1979 | Kuroda et al. . | |
| 4,202,306 | 5/1980 | Nakajima et al. | 123/310 |

FOREIGN PATENT DOCUMENTS

| | | | |
|---|---|---|---|
| 1075106 | 4/1980 | Canada | 123/310 |
| 52-22612 | 2/1977 | Japan | 123/310 |

*Primary Examiner*—Parshotam S. Lall

*Attorney, Agent, or Firm*—Robert J. Outland

[57] ABSTRACT

A compact dual ignition push rod actuated overhead valve internal combustion engine having in a preferred embodiment a 4 cylinder V-type arrangement of 60° bank angle provided with part-spherical combustion chambers having diagonally placed intake and exhaust ports controlled by valves actuated through push rods from a central camshaft and having dual spark plugs with diagonally placed gaps angularly alternating with the ports. The spark plugs extend from the combustion chambers through adjacent outer side and end walls of the cylinder head while the valve actuating push rods pass through openings between the combustion chamber and the cylinder head inner side wall in a compact arrangement for an engine having dual ignition fast burn combustion chambers.

4 Claims, 5 Drawing Figures

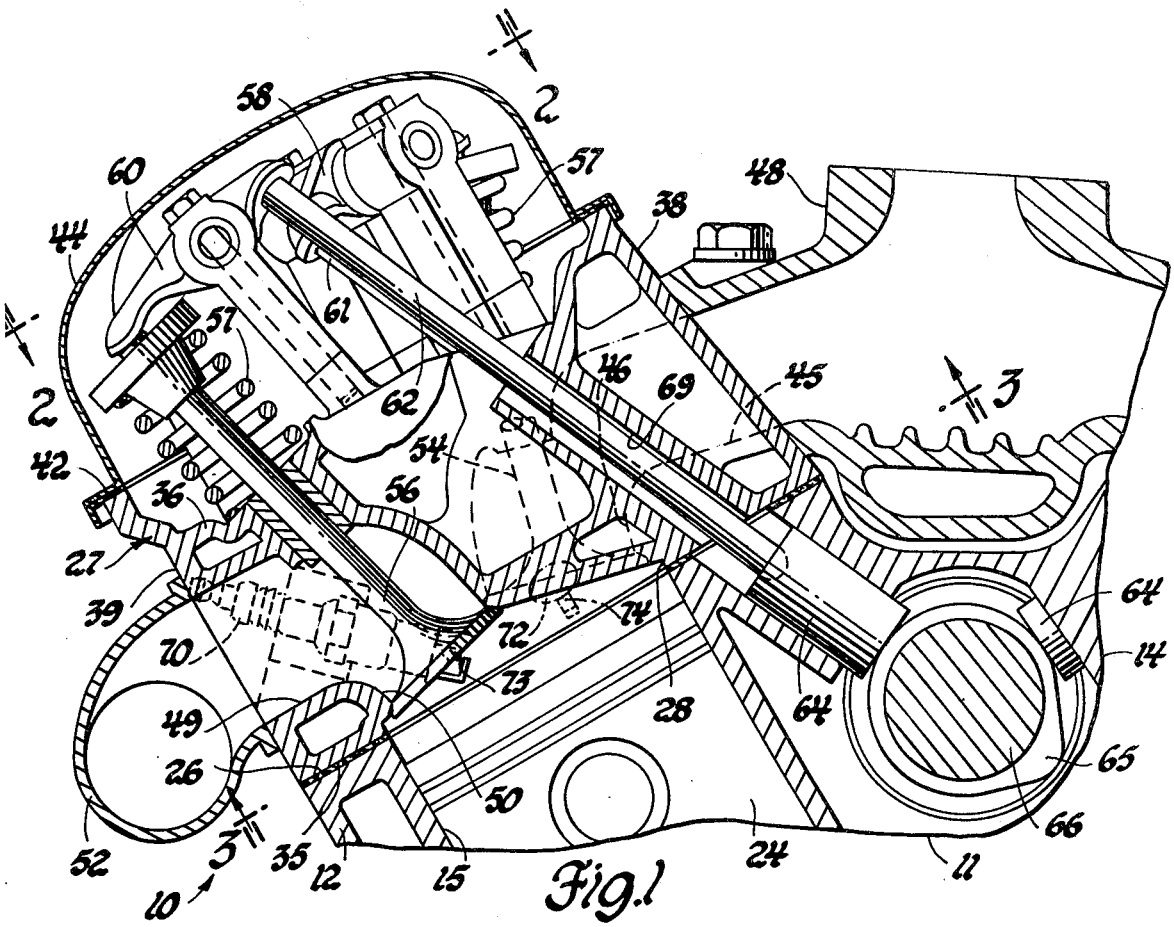
Fig. 1
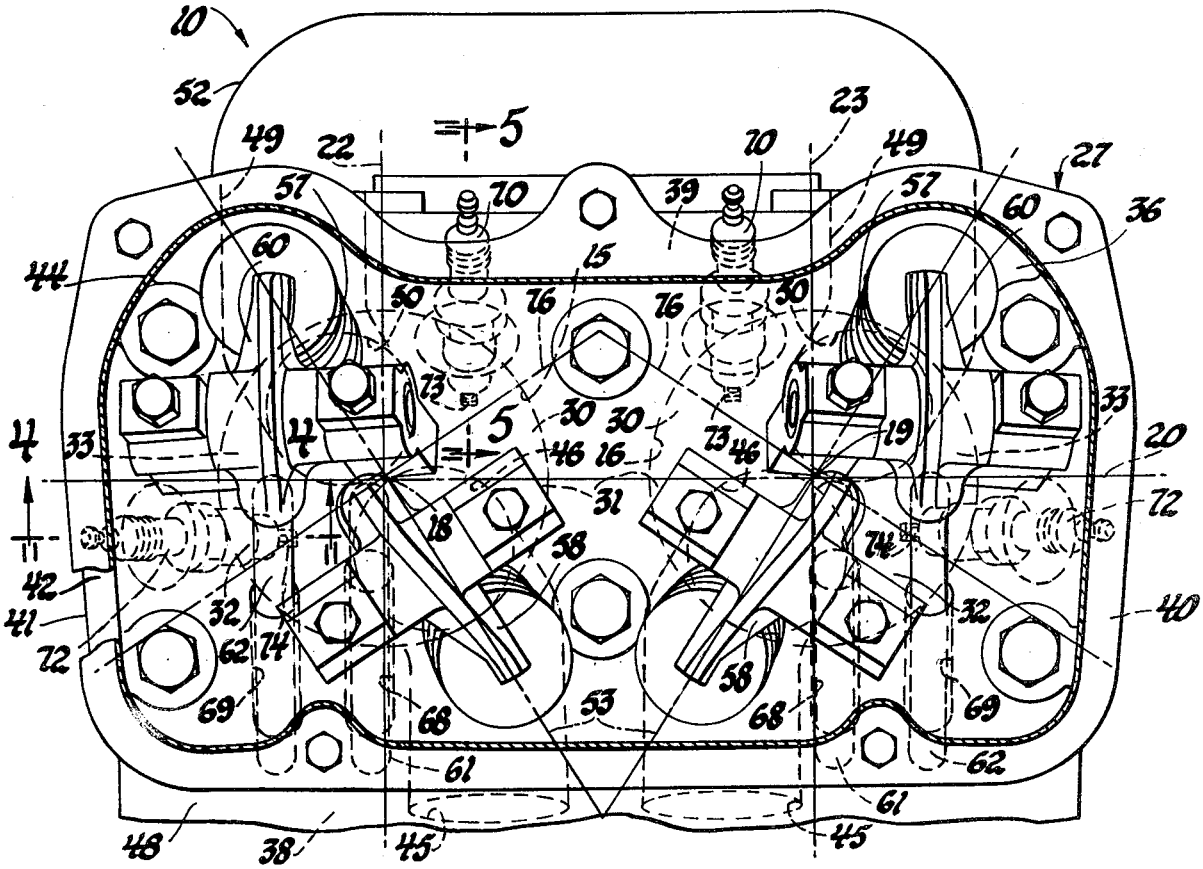

COMPACT DUAL SPARK INTERNAL COMBUSTION ENGINE

TECHNICAL FIELD

This invention relates to internal combustion engines and more particularly to compact arrangements for paired cylinder engines having overhead valves and dual spark plugs.

BACKGROUND

The prior art shows numerous arrangements of valves and ignition means for internal combustion engines as indicated by the following U.S. patents. U.S. Pat. No. 2,609,805 Pescara shows in FIGS. 1-4 an engine having two aligned cylinders per cylinder bank with combustion chambers having push rod actuated overhead valves and oppositely disposed dual spark plugs. The spark plugs extend through the top wall of the cylinder head, requiring an unusual rocker cover and valve gear construction. U.S. Pat. No. 2,827,892 McDuffie et al shows a peaked roof combustion chamber from which dual spark plugs extend through the cylinder head side wall. U.S. Pat. No. 2,833,254 Carpentier et al shows a fast burn modified part-spherical combustion chamber in a V-type engine having overhead valves actuated by push rods from a single centrally located camshaft in conventional fashion. A single spark plug per cylinder opens through the edge of the cylinder head side wall. U.S. Pat. No. 4,116,179 Nagumo et al shows a part-spherical chamber arrangement having dual spark plugs opening through opposite side walls of the cylinder head. Overhead camshaft actuation of overhead valves it utilized.

The prior art fails to illustrate a compact engine arrangement having the benefits of a fast burn part-spherical combustion chamber arrangement having (1) oppositely disposed dual spark plugs that open conventionally through the peripheral walls of the cylinder head below the rocker cover and (2) overhead valves actuated by push rods from a block mounted chamshaft. The latter may allow shorter engine lengths than comparable overhead cam arrangements may also be utilized to operate the valves of more than one cylinder bank. The prior art also fails to suggest a compatible arrangement for push rods, spark plugs and valve gear for such an engine.

SUMMARY OF THE INVENTION

The present invention provides a compact engine arrangement having the advantages previously mentioned as missing from the prior art to thereby provide an extremely compact high efficiency engine.

In a preferred embodiment the invention provides a 60° V-type 4 cylinder engine having two banks of two cylinders each with part-spherical combustion chambers. A block mounted camshaft between the cylinder banks drives push rods that actuate splayed valves in the cylinder head. The valves control diagonally opposite inlet and exhaust port openings into the part-spherical combustion chambers. Dual spark plugs are provided for each cylinder having diagonally opposed spark gaps angularly spaced between the ports. One of the plugs for each cylinder opens conventionally through cylinder head outer side wall while the corresponding diagonally opposite position on the inner side wall is blocked by the push rods. Thus the second of the dual spark plugs for each cylinder is arranged to extend through the adjacent end wall of the cylinder head. The end wall position also has advantages in electrically connecting and servicing the spark plugs over mounting positions in the inner side walls.

It is therefore a feature of the present invention that part-spherical combustion chambers are provided having diagonally opposed intake and exhaust ports opening through opposite side walls of the cylinder head. Another feature is that intake and exhaust valve actuating push rods extend between the combustion chamber and the inner cylinder head side wall adjacent the intake port. Still another feature is that one of the dual spark plugs is spaced arcuately between the intake and exhaust ports and opens through the cylinder head side wall alongside the opening of the associated exhaust port. Yet another feature is that the second of the dual spark plugs has a spark gap diagonally opposite the first and angularly between the intake and exhaust ports inside the position of the push rods that extends to the cylinder head exterior through the adjacent end wall below the position of the rocker cover. A further feature of the invention is that a V-type engine is provided in which a single camshaft between two cylinder banks drives push rods for actuating the valves of the two longitudinally aligned cylinders placed in each bank.

These and other features and advantages of the invention will be more fully referred to in and understood from the following description of a preferred embodiment taken together with the accompanying drawings.

BRIEF DRAWING DESCRIPTION

In the drawings:

FIG. 1 is a transverse cross-sectional view through a portion of a 60° V-4 internal combustion engine in accordance with the invention;

FIG. 2 is a plan view of one of the cylinder banks having the upper portion of the rocker cover removed as seen from the plane indicated by the line 2—2 of FIG. 1;

DETAILED DESCRIPTION

Figure 4:
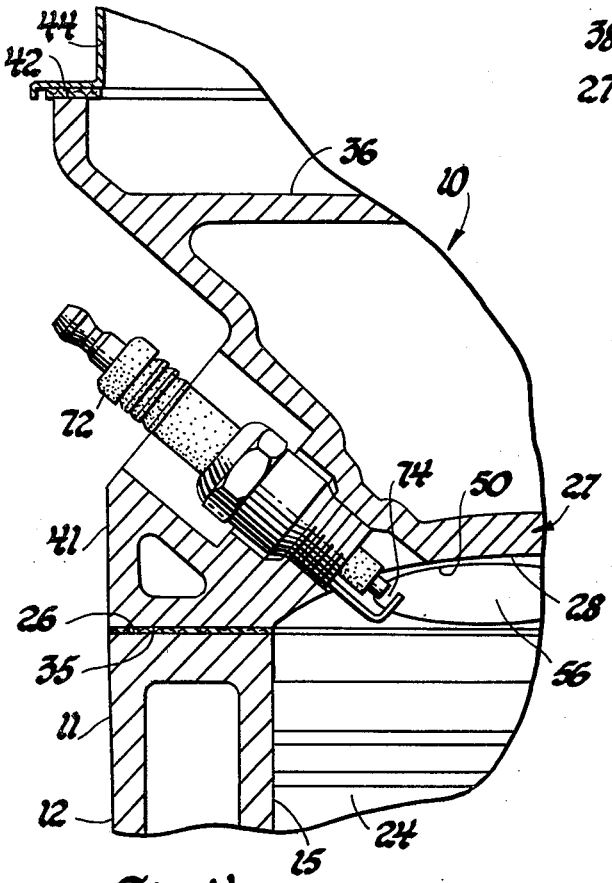
FIG. 4 is a fragmentary cross-sectional view at the location of one of the end wall mounted spark plugs as seen from the plane indicated by the line 4—4 of FIG. 2.
Figure 3:
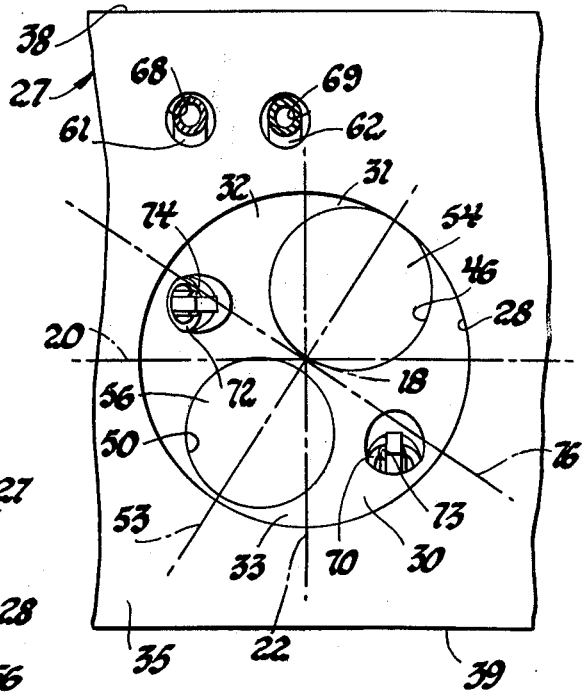
FIG. 3 is a bottom view of a portion of the cylinder head as viewed from the plane indicated by the line 3—3 of FIG. 1.
Figure 5:
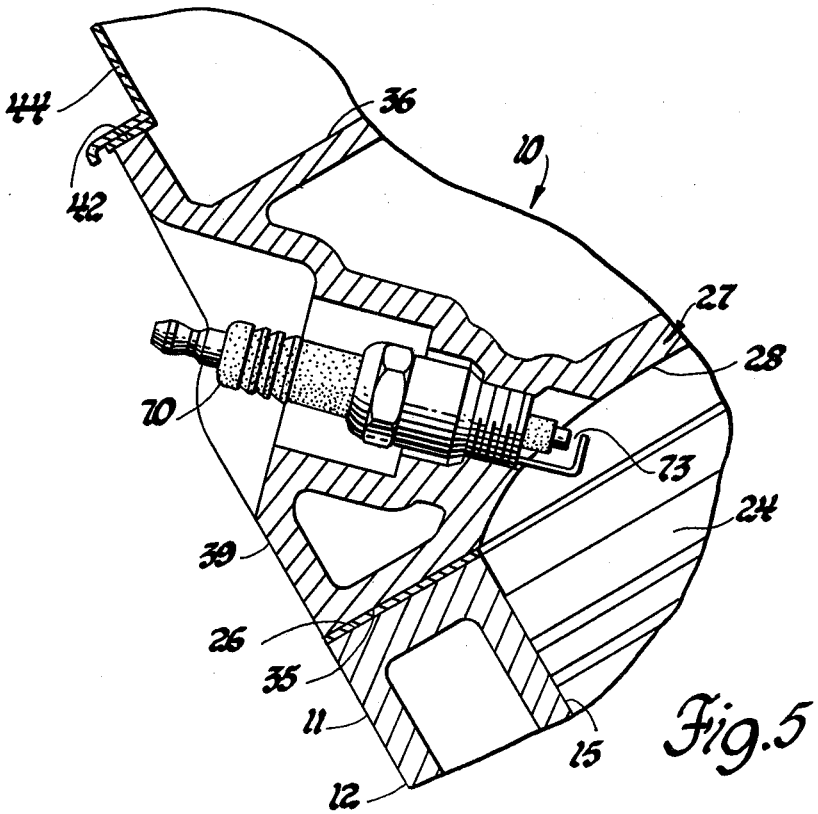
FIG. 5 is a fragmentary cross-sectional view at the location of one of the side wall mounted spark plugs as seen from the plane indicated by the line 5—5 of FIG. 2.

In the drawings numeral 10 generally indicates an internal combustion 60° V-4 engine formed in accordance with the invention. Engine 10 includes a cylinder block 11 defining two cylinder banks 12, 14 arranged at an angle of 60° around the longitudinal axis of a cylinder block supported crankshaft not shown.

Each of the cylinder banks defines a pair of longitudinally aligned cylinders, only two of which 15, 16 defined by the left cylinder bank 12 are shown. The cylinders 15, 16 of each bank are arranged on parallel axes 18, 19 which lie in a common longitudinal plane 20 as well as in individual lateral planes 22, 23 extending normal to the longitudinal plane 20 and transversely of the respective cylinder banks. Within each of the cylinders there is disposed a piston 24 conventionally connected with the engine crankshaft for driving the same.

At their upper ends the cylinders open through planar top walls 26 of their respective cylinder banks.

Mounted on the top wall 26 of each cylinder bank and closing the ends of the cylinders therein is a cylinder head 27. Each cylinder head defines a pair of part-spherical domed combustion chamber recesses 28 located at the ends of their respective cylinders and centered on the cylinder axes so that the longitudinal and transverse planes defined thereby divide the combustion chamber recesses into four substantially equal quadrants identified by numerals 30–33.

The cylinder head further includes a bottom wall 35 mounted against the cylinder block, a top wall 36 opposite the bottom wall, inner and outer side walls 38, 39 respectively and front and rear end walls 40, 41 respectively. The side and end walls peripherally surround the cylinder head and the combustion chamber recesses defined therein. The bottom wall is mounted on the cylinder block top wall 26. The cylinder head top wall 36 extends to the end and side walls, the upper edges 42 of which support a valve cover 44.

Each cylinder is provided with an intake port 45 which opens to its combustion chamber recess 28 through an opening 46 located primarily within the inner-center quadrant 31 of its respective combustion chamber recess and extending outwardly through the cylinder head inner side wall 38. An intake manifold 48, mounted on the inner side walls 38 of opposite cylinder heads, connects with the intake ports 45 to provide premixed fuel air charges thereto from suitable charge forming means not shown.

Each cylinder is further provided with an exhaust port 49 communicating with its respective combustion chamber recess through an opening 50 which lies largely within the outer-end quadrant 33 of its respective combustion chamber and extends outwardly through the cylinder head outer side wall. An exhaust manifold 52 is mounted on the outer side wall 39 of each cylinder head to collect the exhaust gases from the exhuast ports of the head for delivery to the remainder of the exhaust system not shown.

The intake and exhaust port openings 46, 50 respectively, for each cylinder are, by reason of their location in diagonally opposed quadrants of their chamber recess, centered on a diagonal plane 53 which preferably extends through the axis of the respective cylinder and traverses the inner-center and outer-end quadrants of the combustion chamber. Along this plane 53 for each cylinder are reciprocably disposed splayed intake and exhaust valves 54, 56 which respectively control the openings 46, 50 of the intake and exhaust ports and extend upwardly through the cylinder head upper wall 36 into the valve cover. Valve springs 57 yieldably urge the valves 54, 56 toward their closed positions.

Suitable valve gear for actuating the valves to their open positions is provided including intake and exhaust rocker arms 58, 60 respectively, intake and exhaust push rods 61, 62 respectively and cam followers, which are preferably hydraulic lash adjusters 64, engaging the push rods and riding on the respective cams 65 of a longitudinally extending camshaft 66 rotatably carried in the cylinder block centrally between the cylinder banks inwardly alongside the cylinders. The intake and exhaust push rods 61, 62 for each cylinder extend through suitable openings 68, 69 respectively provided in the cylinder head between the combustion chamber recesses and the inner side wall and disposed alongside and inwardly of the inner end quadrant 32 of the respective combustion chamber.

To provide fast burning ignition of fuel charges delivered to the engine combustion chambers through the intake ports, each cylinder is provided with two spark plugs 70, 72 having spark gaps 73, 74 respectively. The spark gaps are diagonally oppositely disposed within their respective combustion chamber recesses and angularly intermediate the positions of their associated intake and exhaust valve openings, close to diagonal planes 76 extending through the respective cylinder axes and normal to the diagonal planes 53 connecting the intake and exhaust port openings. Thus the spark gaps of the spark plugs for each cylinder are disposed within the oppositely located quadrants 30 and 32 of the combustion chamber lying alternately between the quadrants of the intake and exhaust valves.

One of the spark plugs 70 for each combustion chamber, the spark gap of which lies in the outer-center combustion chamber quadrant 30 is positioned so that it may extend in conventional fashion to the cylinder head exterior through the outer side wall 39 thereof, lying generally alongside and inwardly of the adjacent exhaust port 49 for the associated cylinder. The additional spark plug 72 for each cylinder is prevented from extending in symmetrical fashion through the inner side wall of the cylinder head by the location of the adjacent push rods, which lie along the inner-end quadrant 32 of the combustion chamber into which the spark gap 74 of spark plug 72 extends. However in the V-type engine arrangement of the particular embodiment disclosed herein, mounting of the additional spark plugs on the inner side walls of the cylinder heads would direct their protruding ends into the space between the cylinder banks adjacent the intake manifold, a space which is usually crowded and used for mounting other components. These problems are avoided in the arrangement of the present invention by mounting the additonal spark plugs 72 for each cylinder within and extending through the adjacent end walls 40, 41 of the cylinder head. This mounting provides for connection of the additional spark plugs with the electrical system of the engine at locations along the front and rear of the cylinder heads, while the other spark plugs are conventionally arranged for electrical connection along the outer side walls of the respective cylinder heads.

Thus it may be seen that there is provided by the present invention a compact engine arrangement which combines the advantageous features of the conventional close coupled block mounted camshaft driving through push rods the splayed valves of part-spherical combustion chambers having dual spark plugs with oppositely disposed spark gaps and peripherally located electrical connections along the side and end walls of the cylinder heads, while the valve actuating push rods extend through the cylinder head between the combustion chambers and the inner side walls alongside the intake ports. These features as well as others disclosed in the illustrated construction combine to define a high efficiency fast burn combustion chamber engine having a compact arrangement of the cylinder defining components for ease of mounting within a vehicle engine compartment. The alternate quadrant location of the spark gaps and cylinder ports is particularly effective for providing rapid combustion of the cylinder charges so that dilution of the charge by recirculated exhaust gases or excess air may be effectively utilized to control exhaust emissions without unduly slowing combustion and reducing engine efficiency.

While the invention has been described in part by reference to a specific embodiment chosen for purposes of illustration, it should be apparent that numerous changes could be made within the spirit and scope of the inventive concepts disclosed. Accordingly it is intended that the invention not be limited to the specific embodiment or features described but that it have the full scope permitted by the language of the following claims.

The embodiments of the invention in which an exclusive property or privilege is claimed are defined as follows.

1. A dual ignition push rod actuated overhead valve internal combustion engine comprising a cylinder bank defining two in-line cylinders having parallel coplanar axes and closed at their adjacent ends by a cylinder head to define a pair of combustion chambers at the cylinder closed ends, said head including opposite side walls and end walls peripherally enclosing the chambers, means defining intake and exhaust ports opening to each combustion chamber at locations lying in a diagonal plane through the axis of their respective cylinder and forming a substantial angle with the longitudinal and lateral planes through the respective cylinder axis, said ports communicating each chamber through the side walls with opposite sides of the cylinder head and being controlled by valves actuatable by cylinder head mounted rocker arms driven by push rods operatively engaging a camshaft carried alongside the cylinders, and dual spark plugs for each cylinder carried in the cylinder head, said spark plugs having spark gaps located in generally opposite positions in each combustion chamber angularly intermediate the locations of its respective intake and exhaust ports and lying close to a diagonal plane through said cylinder axis and normal to the plane of said port openings said push rods for each cylinder extending through said cylinder head adjacent to one of the cylinder ports and between one of the spark plugs and the adjacent side wall, the other of the spark plugs for each cylinder being mounted in an opening through the opposite side wall and said one of the spark plugs for each cylinder being mounted in an opening through the adjacent end wall, whereby a compact and convenient dual ignition fast burn combustion chamber and valve gear arrangement is provided.

2. A dual ignition push rod actuated overhead valve internal combustion engine comprising a cylinder bank defining two in-line cylinders having parallel coplanar axes and closed at their adjacent ends by a cylinder head having two dished recesses defining a pair of domed combustion chambers at the cylinder closed ends, said head including opposite side walls and end walls peripherally enclosing the chamber recesses, said chambers being each divided into four quadrants by a shared longitudinal plane and normally extending lateral planes through the cylinder axes, means defining cross flow intake and exhaust ports opening to their respective chambers in opposite ones of said quadrants and communicating each chamber recess through the side walls with opposite sides of the cylinder head, said ports being controlled by valves actuatable by cylinder head mounted rocker arms driven by push rods operatively engaging a camshaft carried alongside the cylinders, and dual spark plugs for each cylinder carried in the cylinder head, said spark plugs having spark gaps located in opposite quadrants of each combustion chamber recess angularly intermediate the quadrants of the respective intake and exhaust ports, said push rods for each cylinder extending closely beside their respective combustion chamber in the direction of the adjacent side wall from the quadrant of one of the associated spark plugs, the other of the spark plugs for each cylinder being mounted in an opening through the opposite side wall and said one of the spark plugs for each cylinder being mounted in an opening through the adjacent end wall, whereby a compact and convenient dual ignition fast burn combustion chamber and valve gear arrangement is provided.

3. A dual ignition push rod actuated overhead valve internal combustion engine comprising a cylinder block defining at least one pair of in-line cylinders having parallel coplanar axes, pistons reciprocably movable in the cylinders for rotatingly driving an engine output shaft a cylinder head mounted on the cylinder block and having a bottom wall closing the adjacent ends of the cylinders, said bottom wall having dished recesses at said cylinder ends to define with the pistons and cylinders domed combustion chambers at the closed ends of the cylinders, said cylinder head further including a top wall generally opposite to the bottom wall, a pair of opposite side walls extending between the top and bottom walls and generally aligned longitudinally with the plane of the cylinder axes and a pair of opposite end walls extending between the top and bottom walls and generally transverse to the plane of the cylinder axes, means defining intake ports in the cylinder head, one for each cylinder, extending from one of the side walls to adjacent sides of the dished recesses of their respective cylinders, means defining exhaust ports in the cylinder head one for each cylinder extending from the other of said side walls to other adjacent sides of the dished recesses of their respective cylinders generally opposite from the intake ports a camshaft carried in the cylinder block alongside the cylinders for rotation on a longitudinal axis parallel with the plane of the cylinders, valves carried in the cylinder head and operable to open and close the intake and exhaust ports, said valves extending through the cylinder head top wall rocker arms carried on the cylinder head top wall and operatively engaging the valves, push rods operatively connecting the rocker arms with said camshaft to operate the valves, the push rods of each cylinder passing longitudinally adjacent the one of the inlet and exhaust ports for their respective cylinder and laterally beside the dished recess for such cylinder, and dual spark plugs in the cylinder head for each cylinder, said spark plugs being received in openings communicating with the combustion chamber recesses on opposite sides thereof and spaced circumferentially between the intake and exhaust ports, one of said spark plug openings extending through the cylinder head side wall opposite the location of the push rods and the other of said spark plug openings extending through the cylinder head end wall adjacent the location of the push rods.

4. A dual ignition push rod actuated overhead valve V-4 internal combustion engine comprising a pair of V-arranged cylinder banks each defining two longitudinally aligned cylinders closed at their adjacent ends by a cylinder head having dished recesses defining domed combustion chambers at the cylinder closed ends with opposite inner and outer side walls and end walls peripherally enclosing the two recesses, cross flow intake and exhaust ports respectively communicating each chamber recess through the side walls with opposite inner and outer sides of its respective cylinder, said ports being controlled by valves actuatable by cylinder head mounted rocker arms driven by push rods operatively engaging a camshaft carried between the cylinder banks, and dual spark plugs for each cylinder carried in the respective cylinder heads, said spark plugs having spark gaps located in generally opposed positions of each chamber recess angularly intermediate the locations of their respective intake and exhaust ports, said push rods for each cylinder extending through their respective cylinder heads inwardly of the recesses and adjacent to the intake port for the respective cylinder on the side toward the nearest end wall and between the inner side wall and the nearest one of the associated spark plugs, said one spark plug for each cylinder being mounted in an opening through said adjacent cylinder head end wall and the other spark plug for each cylinder being mounted in an opening through the outer side wall of the cylinder head whereby a compact and convenient dual ignition fast burn combustion chamber and valve gear arrangement is provided.

* * * * *